US006405900B1

(12) United States Patent
Kown

(10) Patent No.: US 6,405,900 B1
(45) Date of Patent: Jun. 18, 2002

(54) POST MIX BEVERAGE DISPENSER WITH STERILIZER

(75) Inventor: Dong Heon Kown, Seoul (KR)

(73) Assignee: Ecoaid Corp., Seoul (KR)

( * ) Notice: Subject to any disclaimer, the term of this patent is extended or adjusted under 35 U.S.C. 154(b) by 0 days.

(21) Appl. No.: 09/818,629

(22) Filed: Mar. 28, 2001

(30) Foreign Application Priority Data

Feb. 16, 2001 (KR) ..... 01-7728

(51) Int. Cl.[7] ..... B67C 3/00
(52) U.S. Cl. ..... 222/190; 222/1; 222/129.1
(58) Field of Search ..... 222/1, 129.1, 190

(56) References Cited

U.S. PATENT DOCUMENTS 5,002,204 A * 3/1991 Sakai ..... 222/129.1
5,587,089 A * 12/1996 Vogel et al. ..... 210/764
5,744,028 A * 4/1998 Goto et al. ..... 210/181
5,900,141 A * 5/1999 Takigawa et al. ..... 210/104
6,126,797 A * 10/2000 Sato et al. ..... 204/272
6,139,717 A * 10/2000 Hayakawa ..... 205/744

* cited by examiner

*Primary Examiner*—J. Casimer Jacyna
(74) *Attorney, Agent, or Firm*—Jacobson Holman, PLLC

(57) ABSTRACT

Provided is a post mix beverage dispenser which can supply beverages in a sanitary manner by additionally installing an apparatus for generating functional water such as ozonated water or electrolyzed water in a high concentration to a conventional post mix beverage dispenser. The post mix beverage dispenser equipped with a sterilizer, including a water supplier for supplying the drinking water; an ingredient container for storing a beverage ingredient; an ingredient supply tube connected to the ingredient container for supplying the beverage ingredient; a carbon dioxide tank for storing and supplying carbon dioxide gas; a mixing tub for mixing the drinking water supplied from the water supplier and the carbon dioxide supplied from the carbon dioxide tank to produce carbonated water; a discharge pump for discharging the beverage ingredient; a dispensing valve opened by the action of a dispensing lever for discharging the carbonated water in the mixing tub and the beverage ingredient; a dispensing nozzle for discharging the carbonated water and the beverage ingredient into a cup; and a functional water generator for generating functional water in the water supplier by facing electrodes provided to operate in water. According to the post mix beverage dispenser, the functional water such as ozonated water or electrolyzed water is generated in the drinking water stored in the water supplier, that is, in the water tank or water supply duct, and simultaneously sterilize, disinfect, deodorize and wash the drinking water as well as the containers and conduits installed in the machine, thereby achieving a sanitary post mix beverage dispenser.

12 Claims, 12 Drawing Sheets

POST MIX BEVERAGE DISPENSER WITH STERILIZER

BACKGROUND OF THE INVENTION

1. Field of the Invention

The present invention relates to a post mix beverage dispenser that can supply various beverages in a sanitary manner by additionally installing an apparatus for generating functional water such as ozonated water or electrolyzed water.

2. Description of the Related Art

In general, a post mix beverage dispenser is configured such that when a user sets a cup to the dispenser and pushes a dispensing lever or button, a selected beverage is poured into a cup. Such a post mix beverage dispenser is installed with a cooler, a dispensing valve, a carbonater, and a tank and a pump for supplying water. The dispenser also has a device connected to a dispensing nozzle and a dispensing valve for driving or supplying carbon dioxide gas, water and beverage ingredients.

FIG. 1 is an external perspective view of a conventional post mix beverage dispenser. Referring to FIG. 1, a conventional post mix beverage dispenser 55 is equipped with a case 51 for housing various devices. At the front side of the case 51, dispensing valves 52 are installed horizontally for supplying various beverages, dispensing nozzles 53 are installed in a protruded condition under the dispensing valves 52 for discharging beverages, and dispensing levers 54 are installed at the back of the dispensing nozzles 53 for opening and closing the dispensing valves 52. When a user puts a cup on a dispensing lever 54 of a selected beverage and pushes the dispensing lever 54 backward, the dispensing valve 52 opens and the selected beverage is poured into the cup.

The greatest concern in such a beverage dispenser is sanitation. In particular, the water stored in the water tank is easily contaminated, resulting in serious deterioration. Also, the water leaking out from the dispensing valves or nozzles when poured into a cup must be often withdrawn. The problem of ill sanitation is raised also in the automatic vending machine of cup beverage that has a structure similar to a post mix beverage dispenser.

To solve the sanitation problem of the vending machine for beverage, there have been conventionally proposed an automatic vending machine configured to sterilize or purify water by installing a sterilizer using a filter, a UV lamp or an ozone generator. However, in the automatic vending machine using a UV lamp, a sufficient sterilizing efficiency cannot be attained. Also, such contamination as developed after radiating by the UV lamp is unavoidable. In case of using ozone gas, it requires a considerable time to be dissolved in water, and the time is dependent upon the shape and size of the ozone gas when it is brought into contact with water. In particular, ozone gas particles with small size are advantageously dissolved in water. Thus, in the automatic vending machine based on a method in which ozone gas is generated in the air and then dissolved in water, an additional device is required for making ozone gas into fine particles. Further, the undissolved ozone gas emanated into the air would be harmful to the user. Thus, it is necessary to remove the harmful ozone gas using a separate device, which increases financial burden of equipment. Also, the user's safety cannot be ensured due to the emanated ozone gas.

The post mix beverage dispenser is sterilized by using chemicals such as chlorine ($Cl_2$) gas. In this case, however, the sterilization process is complicated and time-consuming and the effect and safety of the sterilization cannot be trusted. Further, the cost of chlorine sterilization is high for the management and personal expenses.

SUMMARY OF THE INVENTION

To solve the sanitation problems encountered in the conventional post mix beverage dispenser, it is an object of the present invention to provide a sanitary post mix beverage dispenser which can simultaneously and safely perform sterilization, disinfection, deodorization and washing of water and beverages as well as containers and conduits installed inside the machine, by additionally installing a simple apparatus for generating functional water such as ozonated water or electrolyzed water by means of electrodes operating in water.

To accomplish the above object of the present invention, there is provided a post mix beverage dispenser equipped with a sterilizer, comprising a water supplier for supplying drinking water, an ingredient container for storing a beverage ingredient, an ingredient supply tube connected to the ingredient container for supplying the beverage ingredient, a carbon dioxide tank for storing and supplying carbon dioxide gas, a mixing tub for mixing the drinking water supplied from the water supplier and the carbon dioxide supplied from the carbon dioxide tank to produce carbonated water, a discharge pump for discharging the beverage ingredient, a dispensing valve opened by the action of a dispensing lever for discharging the carbonated water in the mixing tub and the beverage ingredient, a dispensing nozzle for discharging the carbonated water and the beverage ingredient into a cup, and a functional water generator for generating functional water in the water supplier by facing electrodes provided to operate in water.

In the beverage dispenser of the present invention, the functional water generator may be installed in the water supplier and operated by means of supplying a power source to sterilize a water supply passage. Also, the functional water generator may be connected to the ingredient supply tube and operated by means of supplying a power source to sterilize a beverage ingredient supply passage.

The beverage dispenser of the present invention may further comprise a nozzle washing device installed out of the dispensing nozzle, which is operated by supplying a power source to the functional water generator and by draining water in the water tank to sterilize both the inside and outside of the dispensing nozzle.

In the beverage dispenser of the present invention, the functional water generator may be an ozonated water generator having at least one pair of facing electrodes or an electrolyzed water generator having at least one pair of facing electrodes disposed with a separating layer interposed therebetween. The facing electrodes are made of platinum (Pt), a platinum/palladium (Pt/Pd) alloy or a Pt group/Pd alloy. Alternatively, the facing electrodes may be made of a conductive metal coated with platinum (Pt), a platinum/palladium (Pt/Pd) alloy or a Pt group/Pd alloy. The conductive metal is preferably titanium (Ti). In case of using the Pt/Pd alloy, 85.0 to 99.95 wt % of Pt and 15.0 to 0.05 wt % of Pd are preferably contained in the alloy. Also, the facing electrodes are preferably carbon electrodes having electric conductivity.

The facing electrodes may be of a plane type, a flat panel type having one or more holes, a small strip type, a fine wire type, a fish bone type, a mesh type or a cylinder type, and the distance of the facing electrodes is preferably in the range of 0.1 to 10 mm.

Also, the beverage dispenser of the present invention may further include a power source for applying a voltage to the functional water generator. The power may be a direct-current (DC) voltage, a pulse voltage, a square wave pulse voltage, a sequence-controlled pulse voltage or an alternating pulse voltage.

According to another aspect of the present invention, there is provided a post mix beverage dispenser equipped with a sterilizer, comprising means for storing and supplying drinking water, means for storing and supplying a beverage ingredient, means for storing and supplying carbon dioxide, means for mixing the supplied drinking water and the carbon dioxide to produce carbonated water, means for discharging the beverage ingredient and carbonated water to the outside, and means for generating functional water in the drinking water by means of facing electrodes provided to operate in water.

According to another aspect of the present invention, there is provided a sterilizing and washing method of a post mix beverage dispenser having a water supplier for supplying drinking water, an ingredient container for storing a beverage ingredient, an ingredient supply tube connected to the ingredient container for supplying the beverage ingredient, a carbon dioxide tank for storing and supplying carbon dioxide gas, a mixing tub for mixing the drinking water supplied from the water supplier and the carbon dioxide supplied from the carbon dioxide tank to produce carbonated water, a discharge pump for discharging the beverage ingredient, a dispensing valve opened by the action of a dispensing lever for discharging the carbonated water in the mixing tub and the beverage ingredient, and a dispensing nozzle for discharging the carbonated water and the beverage ingredient into a cup, wherein the method includes the steps of generating functional water in the water supplier by facing electrodes provided to operate in water, and discharging the functional water to the dispensing nozzle through the mixing tub, or through the ingredient supply tube.

The feature of the present invention lies in that the functional water generator for generating functional water having various functions of sterilization, disinfection, deodorization or washing is installed in the water supplier, that is, in the water tank or water supply duct of a post mix beverage dispenser, to generate functional water in the water contained in the water tank or passing through the water supply duct, thereby performing sterilization, disinfection, deodorization and washing of water and beverages as well as containers and conduits installed in the dispenser. In the beverage dispenser according to the present invention, the functional water generator includes at least one pair of facing electrodes so that when a voltage is applied to the electrodes, the water contained in the water tank or passing through the water supply duct is electrolyzed to generate functional water. While the conventional automatic vending machine with an ozone gas generator operated in air requires equipments for dissolving the generated ozone gas into the water stored in the water tank, and the conventional post mix beverage dispenser sterilized by chlorine gas needs high cost of management and personal expenses, in the post mix beverage dispenser according to the present invention, sterilization, disinfection, deodorization or washing of both containers and ducts in the dispenser and drinking water can be simultaneously performed without such additional equipment and high cost, or causing a safety problem due to undissolved ozone gas or chlorine.

BRIEF DESCRIPTION OF THE DRAWINGS

The above object and advantages of the present invention will become more apparent by describing in detail a preferred embodiment thereof with reference to the attached drawings in which:

FIGS. 6A through 6D illustrate an example of an ozonated water generator for use in the post mix beverage dispenser according to the present invention, in which FIG. 6A shows one of two facing electrodes, FIG. 6B shows a spacer for maintaining a gap between the facing electrodes, FIG. 6C shows an electrode fixing frame, and FIG. 6D shows a bare-type ozonated water generator;

DESCRIPTION OF THE PREFERRED EMBODIMENTS

The present invention will now be described by the following embodiments in more detail with reference to the accompanying drawings. However, these embodiments are illustrations only provided for a better understanding of the invention, not for the purpose of limiting.

Figure 1:
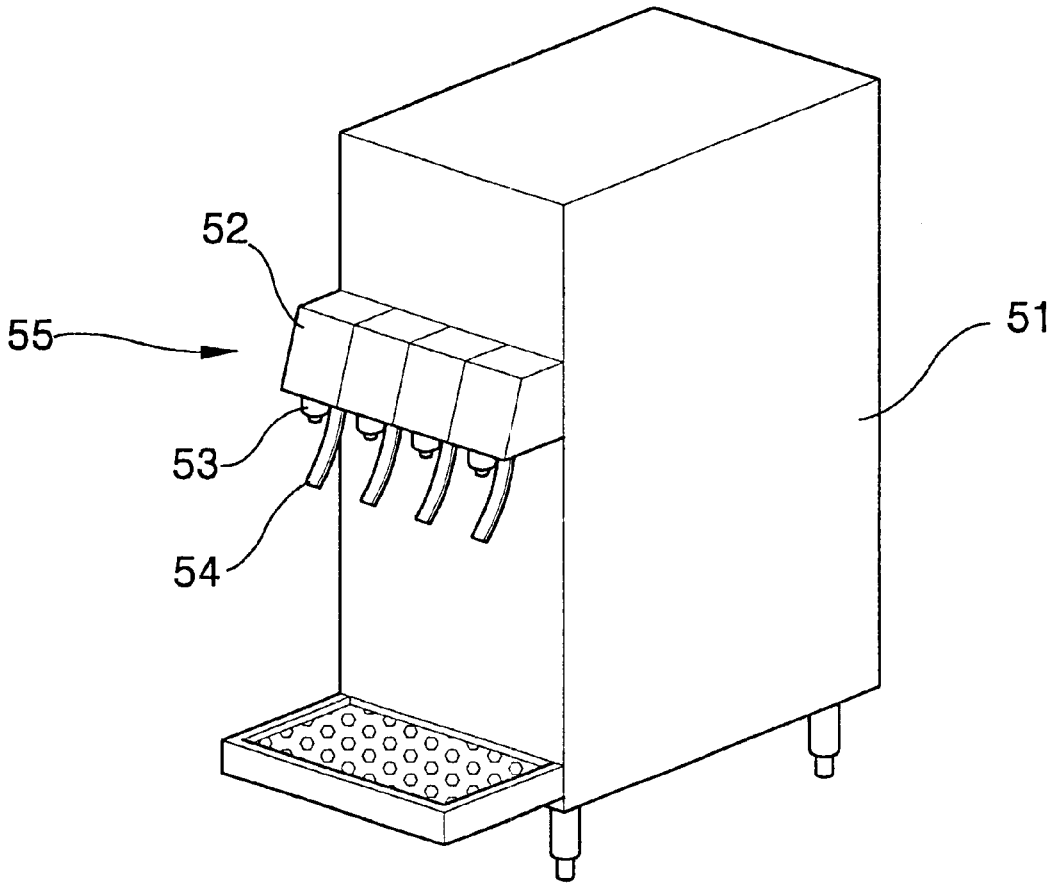
FIG. 1 is an external perspective view of a conventional post mix beverage dispenser.
Figure 2:
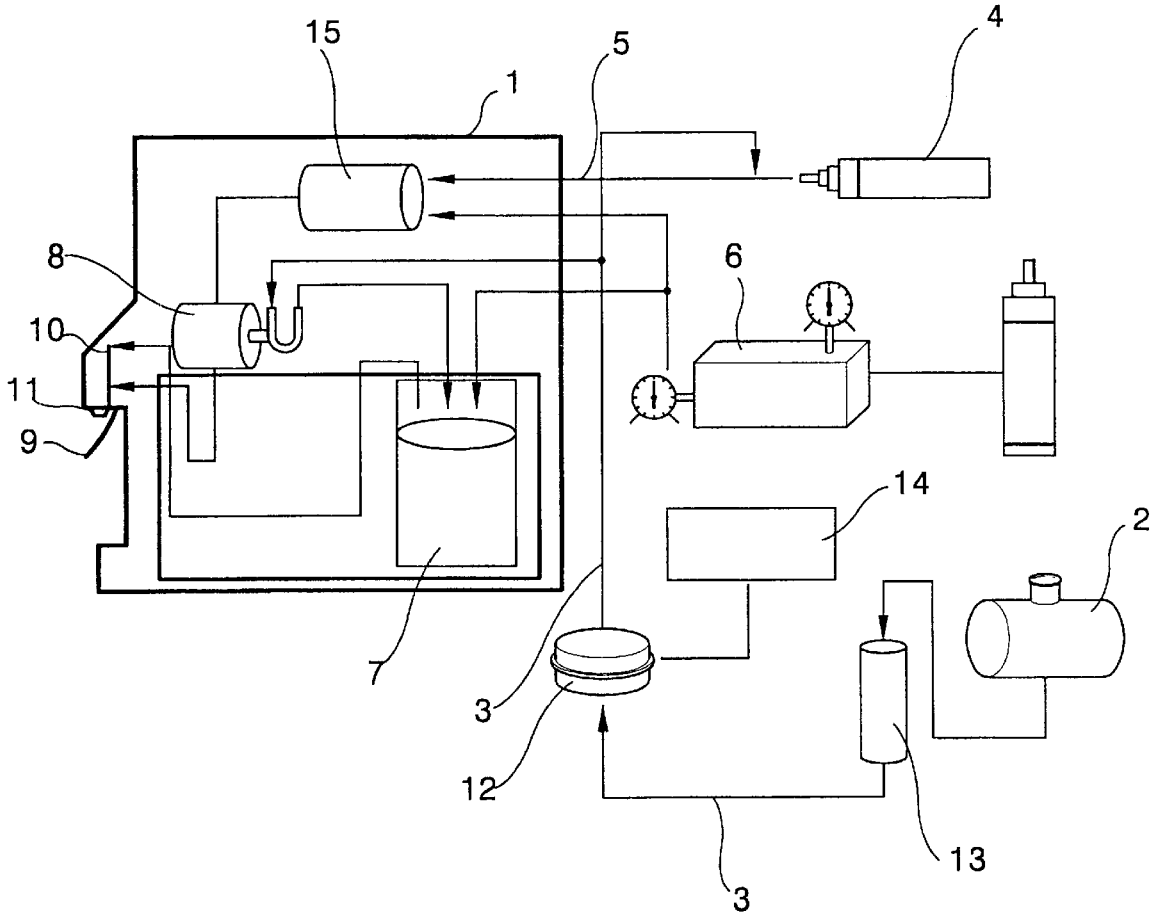
FIG. 2 schematically illustrates the operation mechanism of the post mix beverage dispenser with a sterilizer according to an embodiment of the present invention.

FIG. 2 schematically illustrates the operation mechanism of the post mix beverage dispensers with a sterilizer according to an embodiment of the present invention. Referring to FIG. 2, the post mix beverage dispenser 1 of the present invention includes a water tank 2 for storing drinking water, and a water supply duct 3 connected to the water tank 2 for supplying the drinking water, which constitute a water supply passage. In the water supply duct 3, there is installed a purifying filter 13. In the beverage dispenser 1 according to the present invention, the water tank 2 and the water supply duct 3 constitute a water supplier. Alternatively, the water supply duct 3 may be directly connected to a faucet, instead of the water tank 2. As an ingredient supply passage, an ingredient container 4 for storing a beverage ingredient, and an ingredient supply tube 5 connected to the ingredient container 4 for supplying the beverage ingredient are connected to a discharge pump 8 for discharging the beverage ingredient in the ingredient container 4. Between the ingredient container 4 and the discharge pump 8, there is installed an ingredient pump 15 for transporting the ingredient in the ingredient container 4 easily to the discharge pump 8. A carbon dioxide tank 6 for storing and supplying carbon dioxide gas is also installed in the beverage dispenser 1. Further, a mixing tub 7 for mixing the drinking water supplied from the water tank 2 and the carbon dioxide supplied from the carbon dioxide tank 6 to produce carbonated water is equipped in a cooling bath of the beverage dispenser 1. At the front side of the beverage dispenser 1, there is installed a dispensing valve 10 for discharging the carbonated water produced in the mixing tub 7 and the beverage ingredient. Further, a dispensing nozzle 11 is mounted under the dispensing valve 10 for discharging a mixed beverage into a cup, and a dispensing lever 9 is mounted at the back of the dispensing nozzle 11 for opening the dispensing valve 10. Such configuration as described above is same as the conventional post mix beverage dispenser.

As a characteristic feature of the post mix beverage dispenser according to the present invention, a functional water generator 12 is mounted in the water supply duct 3, and a power source 14 for applying voltage is connected to the functional water generator 12.

Next, the operation of the post mix beverage dispenser with a functional water generator according to the present invention will be described. When a user selects one kind of beverages and pushes the dispensing lever 9 or a discharge button, the beverage ingredient contained in the ingredient container 4 passes through the ingredient supply tube 5 to the dispensing valve 10 by the action of the ingredient pump 15 and the discharge pump 8, and carbonated water produced in the mixing tub 7 is transported simultaneously to the dispensing valve 10. Then, with the backward movement of the dispensing lever 9, the dispensing valve 10 opens and the selected beverage, which is a mixture of the beverage ingredient and carbonated water, is poured into the cup through the dispensing nozzle 11.

The functional water generator 12 mounted in the water supply duct 3 starts to operate with the application of a voltage to the power source 14, so that the water in the water supply duct 3, supplied from the water tank 2, is electrolyzed to generate functional water. The functional water generated in the water supply duct 3 sterilizes, disinfects, deodorizes and washes the conduits and containers installed inside the beverage dispenser 1 while passing through the water supply duct 3, the ingredient supply tube 5 and the mixing tub 7, and discharged through the dispensing valve 10 and the dispensing nozzle 11. The passage of the functional water can be controlled by the change of the flow passage using a connection pipe or so.

While in the embodiment shown in FIG. 2 the functional water generator 12 is mounted in the water supply tube 3, it can be installed in the water tank 2. In this case, the drinking water in the water tank 2 is electrolyzed to be functional water, and the generated functional water also sterilizes, disinfects, deodorizes and washes the conduits and containers installed in the beverage dispenser 1.

Figure 3:
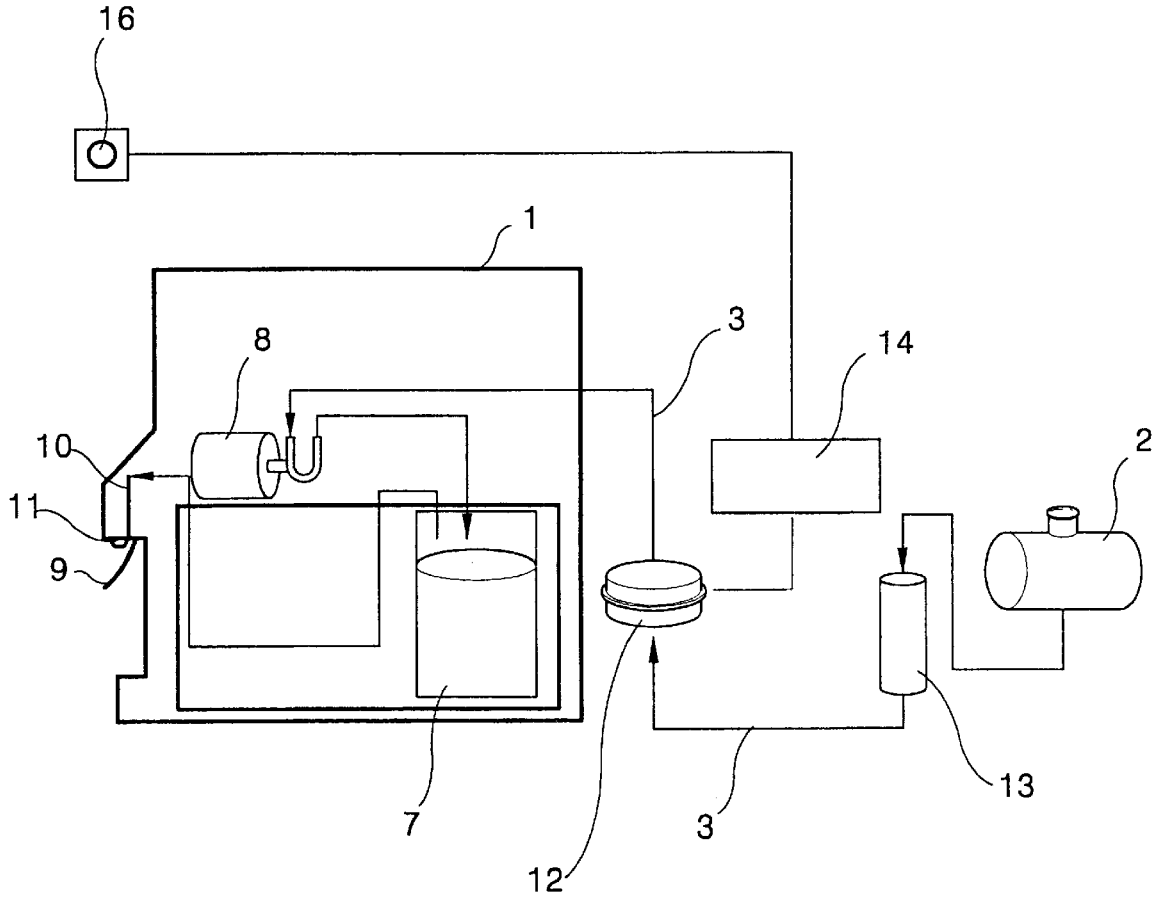
FIG. 3 schematically illustrates the operation mechanism to sterilize, disinfect, deodorize and wash the water supply passage in the post mix beverage dispenser with a sterilizer according to an embodiment of the present invention.

FIG. 3 schematically illustrates the operation mechanism to sterilize, disinfect, deodorize and wash the water supply passage in the post mix beverage dispenser with a sterilizer according to an embodiment of the present invention. First, when a user pushes the sterilization button 16 installed in a predetermined place and applies a voltage to the power source 14, the functional water generator 12 starts to operate. With the discharge of water by pushing the dispensing lever 9, the drinking water in the water tank 2 passes through the purifying filter 13 and the functional water generator 12 mounted in the water supply duct 3 to generate functional water such as ozonated water or electrolyzed water. The functional water generated in the functional water generator 12 sterilizes, disinfects, deodorizes and washes the water supply passage while passing through the water supply duct 3 and the mixing tub 7 by the action of the discharge pump 8 until discharged. Passing the functional water through the water supply passage for about 10–20 seconds sterilizes all the bacteria including *E. coli* which inhabit the conduit.

Figure 4:
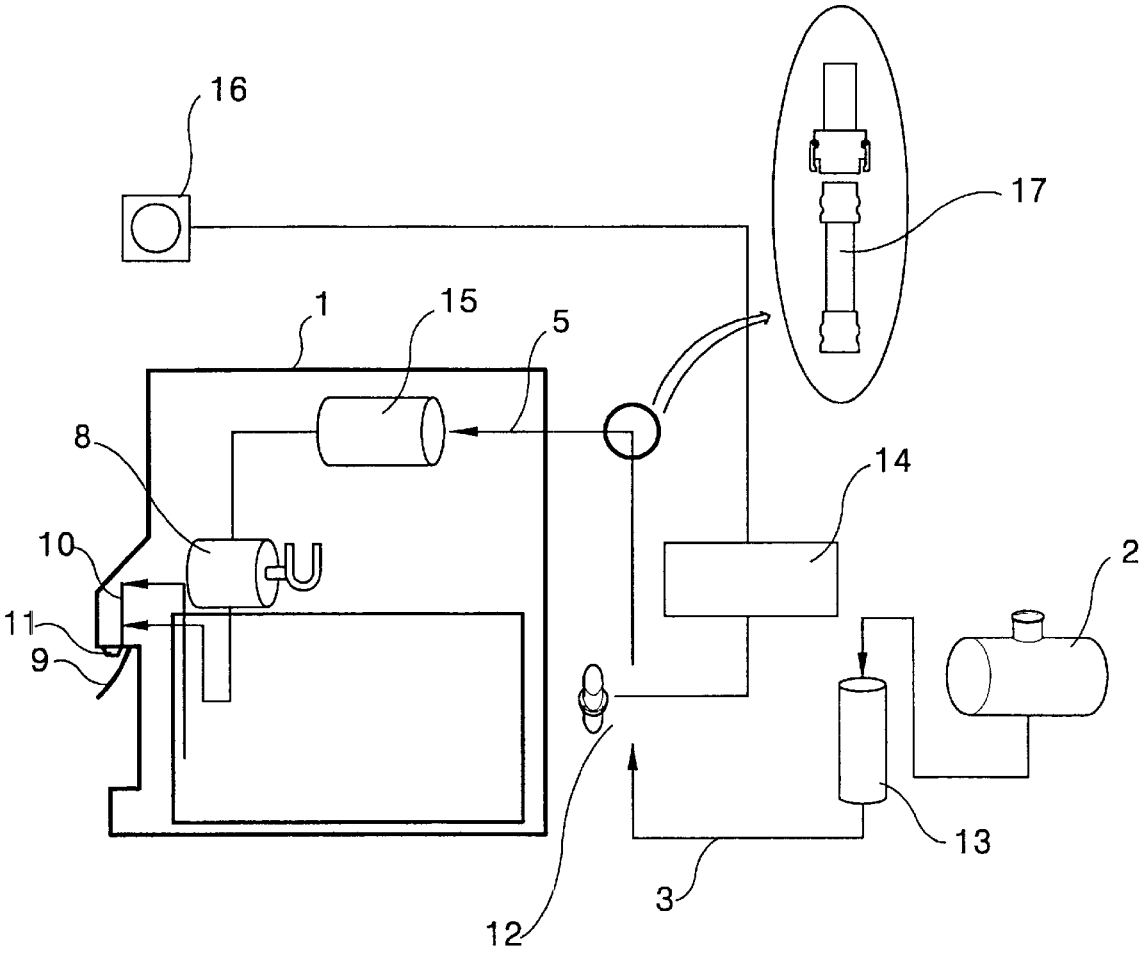
FIG. 4 schematically illustrates the operation mechanism to sterilize, disinfect, deodorize and wash the ingredient supply passage in the post mix beverage dispenser with a sterilizer according to another embodiment of the present invention.

FIG. 4 schematically illustrates the operation mechanism to sterilize, disinfect, deodorize and wash the ingredient supply passage in the post mix beverage dispenser with a sterilizer according to another embodiment of the present invention. First, the functional water generator 12 is connected to the ingredient supply tube 5 by means of a connection pipe 17, and then the sterilization button 16 installed in a predetermined place is pushed to apply a voltage to the power source 14, thereby working the functional water generator 12. With the discharge of water by pushing the dispensing lever 9, the drinking water in the water tank 2 passes through the purifying filter 13 and the functional water generator 12 mounted in the water supply duct 3 to generate functional water such as ozonated water or electrolyzed water. The functional water generated in the functional water generator 12 sterilizes, disinfects, deodorizes and washes the ingredient supply passage while passing through the water supply duct 3 and ingredient supply tube 5 by the action of the ingredient pump 15 and discharge pump 8 until discharged. Passing the functional water through the ingredient supply passage for about 10–20 seconds sterilizes all the bacteria, fungi and yeasts which inhabit the conduit.

Figure 5:
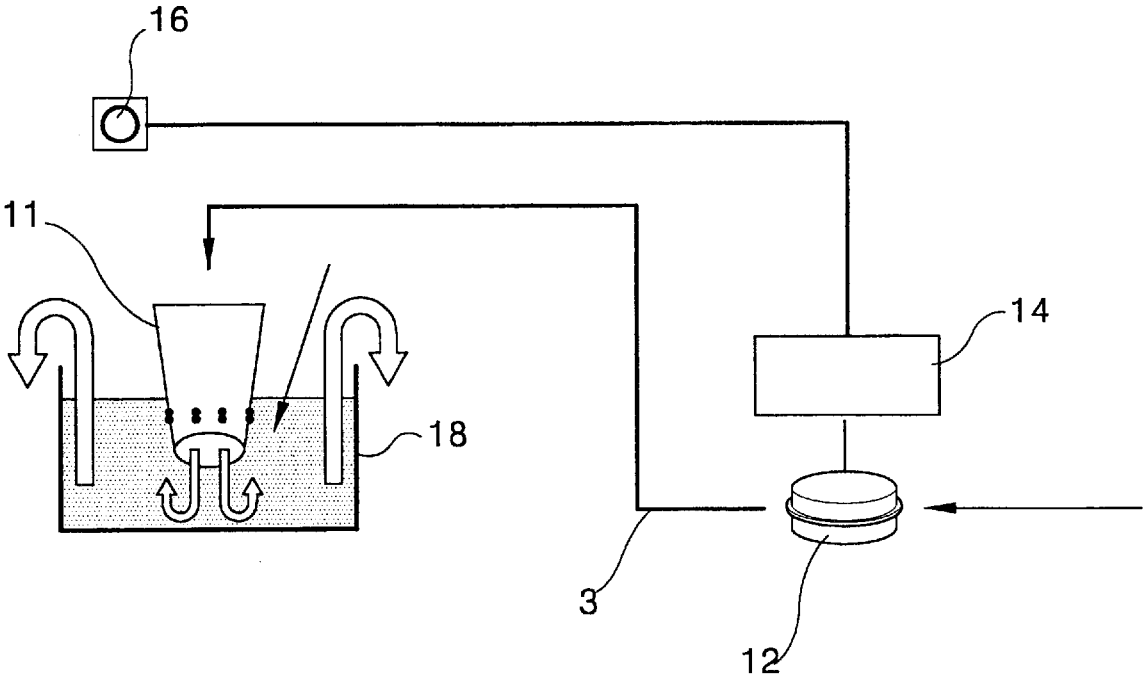
FIG. 5 schematically illustrates the operation mechanism to sterilize, disinfect, deodorize and wash the dispensing nozzle in the post mix beverage dispenser with a sterilizer according to still another embodiment of the present invention.

FIG. 5 schematically illustrates the operation mechanism to sterilize, disinfect, deodorize and wash the dispensing nozzle in the post mix beverage dispenser with a sterilizer according to still another embodiment of the present invention. First, a washing device 18 is installed out of the dispensing nozzle 11, and then the sterilization button 16 is pushed to apply a voltage to the power source 14, thereby working the functional water generator 12. Upon draining the drinking water in the water tank 2, the drinking water passes through the functional water generator 12 to generate functional water such as ozonated water or electrolyzed water. The generated functional water fills the washing device 18, and then sterilizes, disinfects, deodorizes and washes the inside and outside of the dispensing nozzle 11. Contacting the functional water with the dispensing nozzle 11 sterilizes all the bacteria, fungi and yeasts which inhabit the nozzle part.

The sterilizer consisted of the functional water generator 12, the power source 14 connected to the functional water generator 12, and the sterilizing button 18 can be used in the post mix beverage dispenser 1 and various kind of beverage dispensers, such as a mobile type post mix beverage dispenser, a combination type beverage dispenser, an ice cream manufacturing device, and an ice cake manufacturing device to sterilize, disinfect, deodorize and washes containers, ducts and nozzles as well as drinking water therein.

The functional water generated from the functional water generator 12 includes concentrated ozone or cations or anions, and therefore sterilizes, disinfects, deodorizes and washes the inside of the machine and drinking water and then normally be discharged outside. In case of ozonated water containing a large quantity of oxygen molecules, the flavor of water is enhanced as the amount of dissolved oxygen increases, thereby improving the flavor of a beverage. Eventually, the post mix beverage dispenser according to the present invention may provide a sterilized oxygen-rich beverage.

A functional water generator mounted in the post mix beverage dispenser according to the present invention will now be described in detail. In the present invention, the functional water may be either ozonated water or electrolyzed water. Thus, the functional water generator may include an ozonated water generator and an electrolyzed water generator.

Figure 6A:
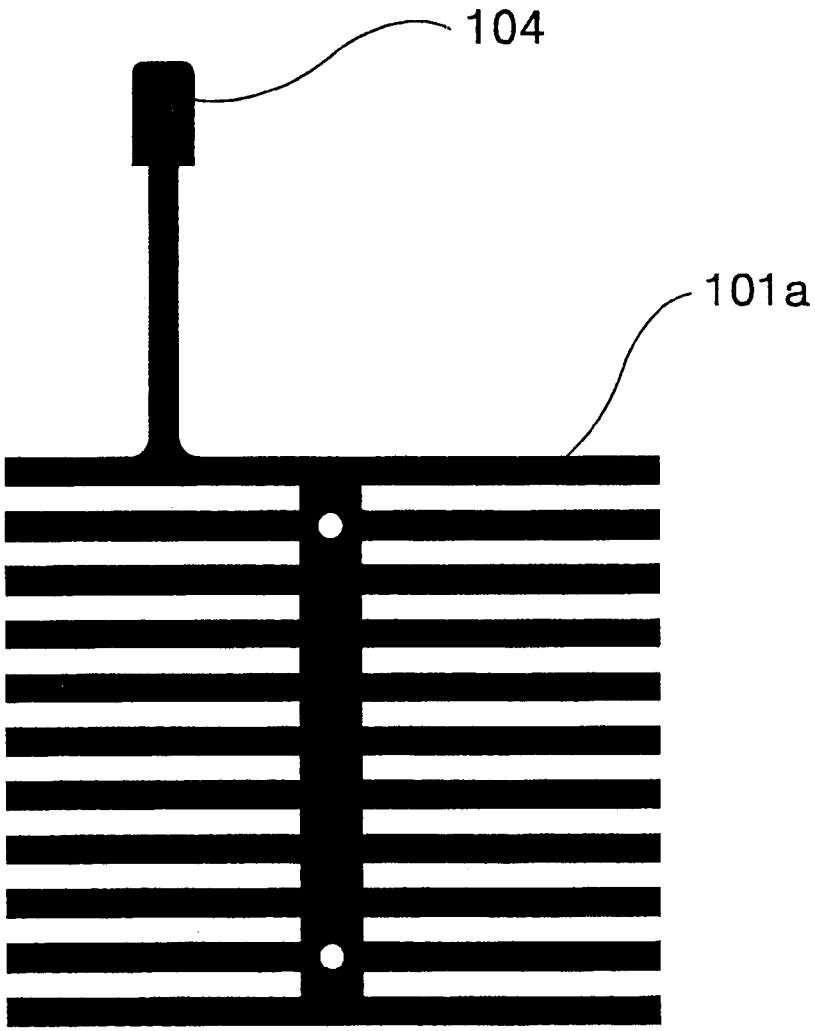
Figure 6B:
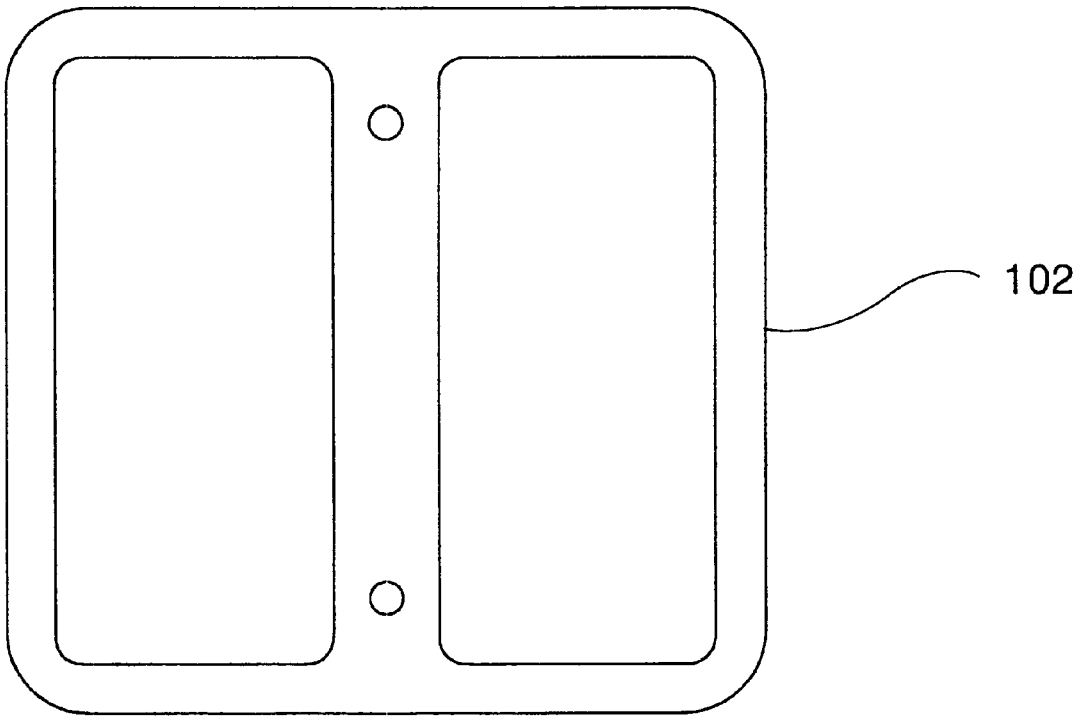
Figure 6C:
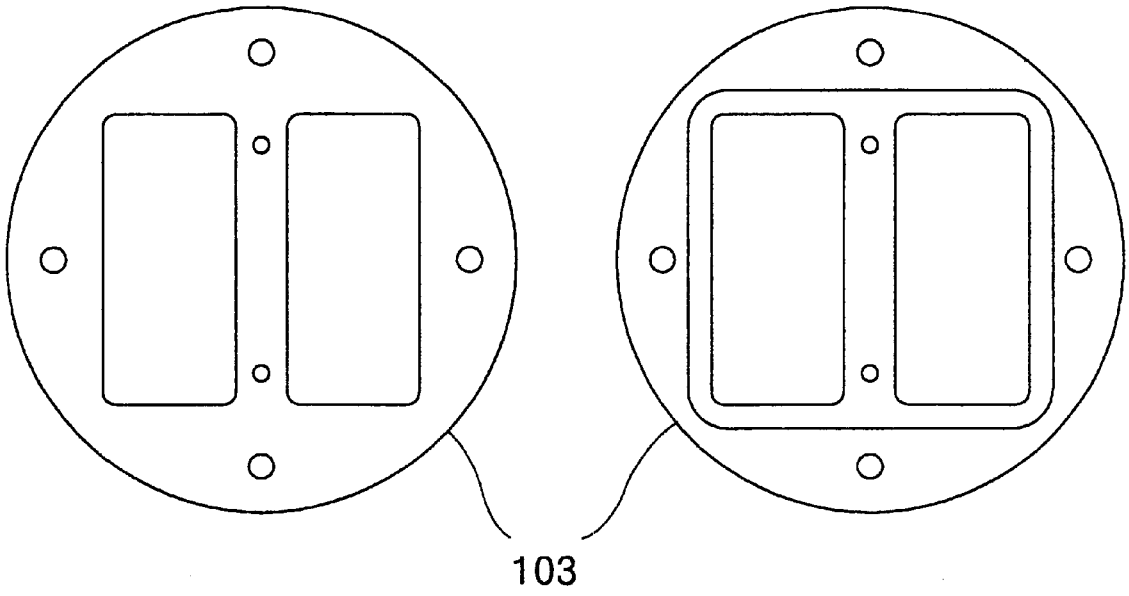
Figure 6D:
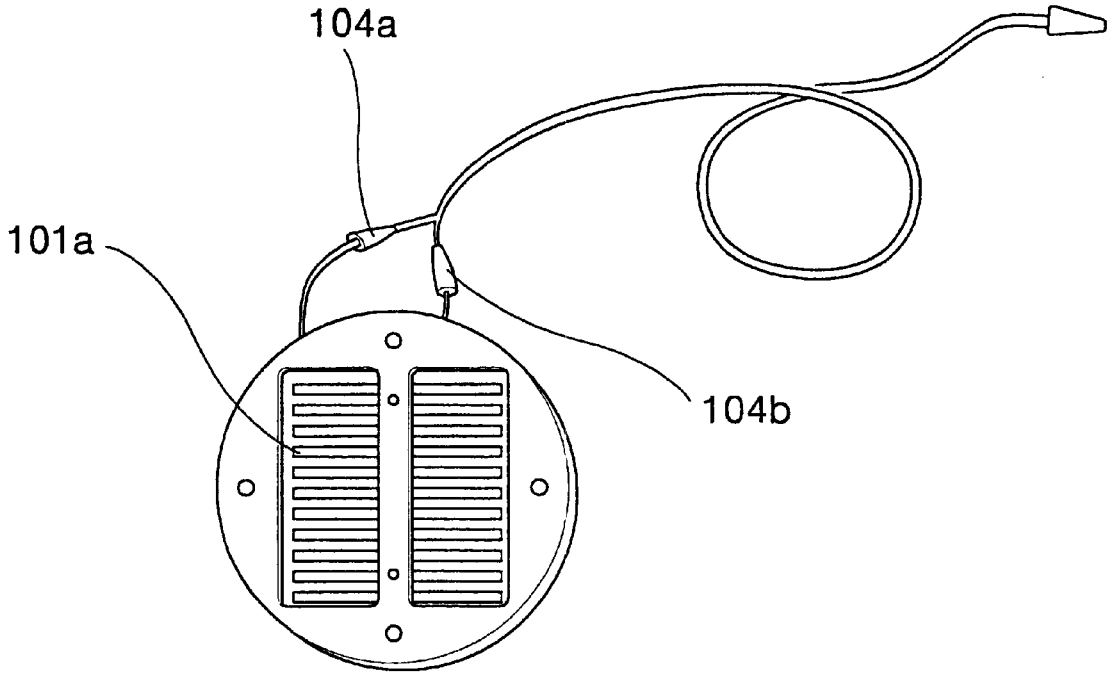

First, the ozonated water generator includes at least one pair of facing electrodes. FIGS. 6A through 6D illustrate an example of an ozonated water generator for use in the post mix beverage dispenser according to the present invention. FIG. 6A shows one of a pair of facing electrodes 101*a* and 101*b* of a fish bone type, FIG. 6B shows a spacer 102 for maintaining a gap between a pair of the facing electrodes, FIG. 6C shows an electrode fixing frame 103, and FIG. 6D shows an ozonated water generator fixed on the frame 103, in which a pair of facing electrodes 101*a* and 101*b* are vertically disposed with the spacer 102 interposed therebetween. The ozonated water generator shown in FIGS. 6A through 6D is generally called a bare type or nude type ozonated water generator having bare electrodes, and is directly put into water as used. External electrode connection terminals 104*a* and 104*b* are provided at one side of each of the facing electrodes 101*a* and 101*b*, respectively. When a voltage is applied to the external electrode connection terminals 104*a* and 104*b*, water molecules are decomposed between the facing electrodes 101*a* and 101*b* to generate ozone, thereby generating ozonated water. The bare type ozonated water generator is not required to be fixed in water and can be preferably used when control of water flow is not required. Thus, in the post mix beverage dispenser according to the present invention, the ozonated water generator of bare type is desirably installed in the water tank.

Figure 7:
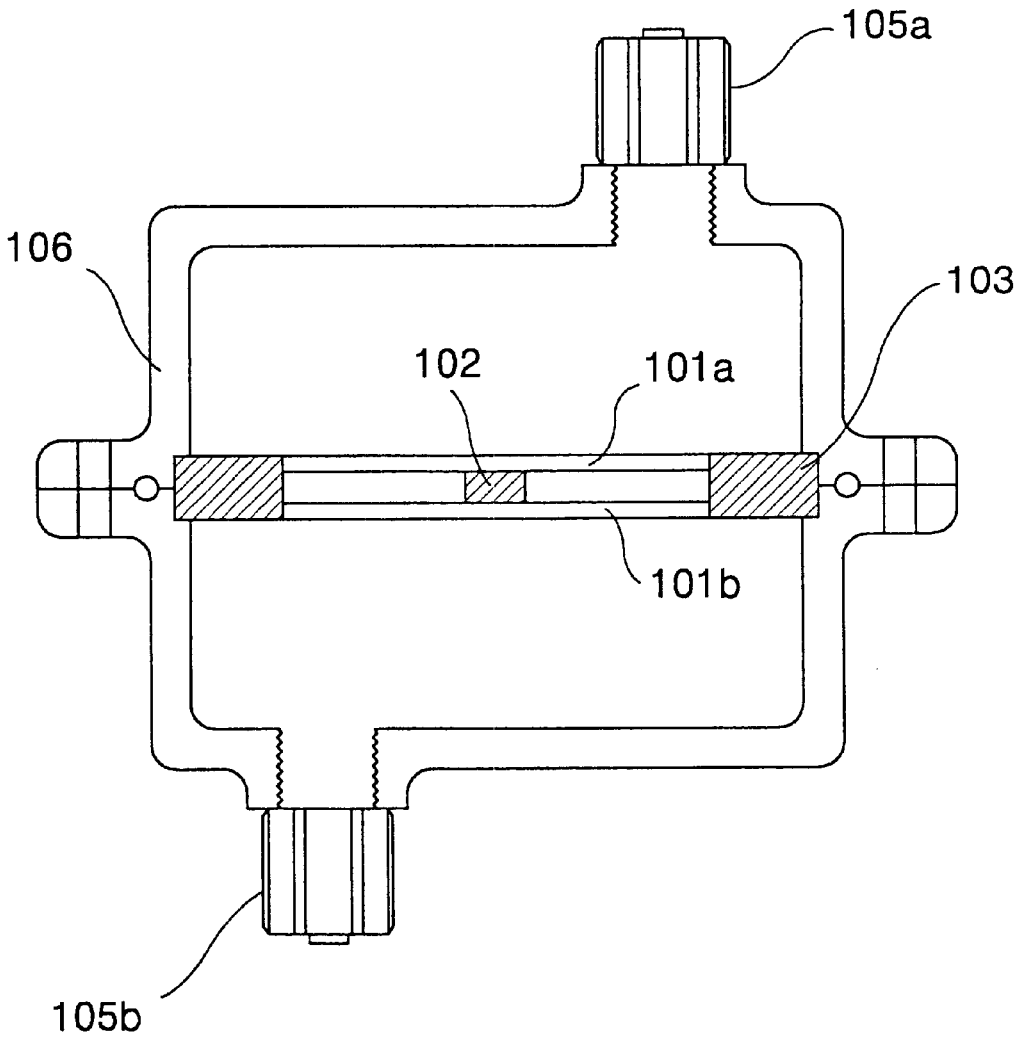
FIG. 7 is a cross-sectional view showing another example of an ozonated water generator for use in the post mix beverage dispenser according to the present invention.

FIG. 7 is a cross-sectional view showing another example of an ozonated water generator for use in the post mix beverage dispenser according to the present invention. The ozonated water generator includes a pair of facing electrodes 101*a* and 101*b* vertically disposed with a spacer 102 interposed therebetween and then fixed to a frame 103. The ozonated water generator, mounted inside a container 106 having water inlet and outlet 105*a* and 105*b*, is generally called a cell type ozonated water generator. Since the ozonated water generator of cell type has water inlet and outlet, it may be fixed to the wall or bottom and be preferably used when control of water flow is required. In the post mix beverage dispenser of the present invention, the ozonated water generator of cell type is desirably used in the embodiments shown in FIG. 2 in which the functional water generator is mounted in the water supply duct.

Figure 8:
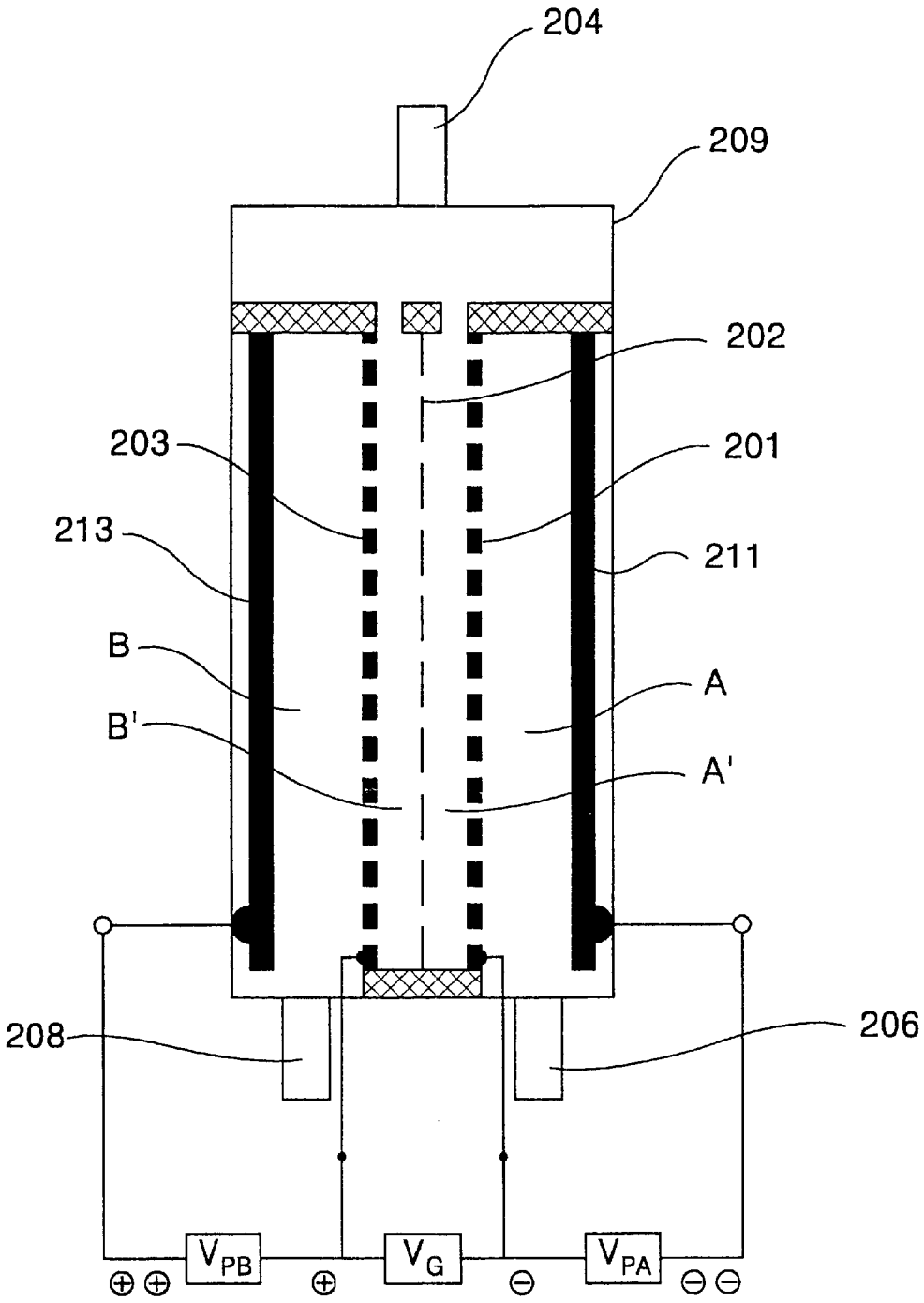
FIG. 8 is a schematic diagram showing an example of an electrolyzed water generator for use in the post mix beverage dispenser according to the present invention.

FIG. 8 is a schematic diagram showing an example of an electrolyzed water generator for use in the post mix beverage dispenser according to the present invention. The electrolyzed water generator is constructed such that a positive electrode 203 and a negative electrode 201 face to each other with a separating layer 202 disposed therebetween in a case 209 having a water supply duct 204 and an electrolyzed water drain ducts 206 and 208. During passed from the water supply duct 204 through the facing electrodes 201 and 203, the supplied water is electrolyzed by a voltage applied to the electrodes to generate acid water and alkali water, each of which is drained through the drain duct 206 and 208, respectively. The electrolyzed water generator shown in FIG. 8 has an external negative electrode 211 out of the negative electrode 201, and an external positive electrode 213 out of the positive electrode 203. The dense electric charges formed between the positive electrode 203 and the separating layer 202 and between the negative electrode 201 and the separating layer 202 move swiftly to the fields A and B, outer of the positive electrode water field B' and negative electrode water field A' by the static electricity (Coulomb attraction) due to the pulse voltage of B (VPB) and pulse voltage of A (VPA). Therefore, the electric charges between the two electrodes 201 and 203 decreases greatly along with the space charge limiting action, which improves the generation of ions and strong oxidizing materials. That is, the dense electric charges between the facing electrodes 201 and 203 as well as the electrolyzed water dissolved with ions and strong oxidizing materials move easily to the negative electrode water field A and positive electrode water field B, thereby greatly decreasing the turbulence, space charge limiting action and thermal decomposition. Accordingly, the generation of the electrolyzed water with ions and strong oxidizing materials increases effectively.

In the electrolyzed water generator, the positive electrode water output from the drain duct of the positive electrode is acid water containing strong oxidizing materials, for example, a large amount of $O_3$ and trace amounts of $O_2$, O and $H_2O_2$. The negative electrode water output from the drain duct of the negative electrode is alkali water. The amount and ion concentration of the strong oxidizing materials such as $O_3$, $O_2$, O, $H_2O_2$ or the like, can be easily adjusted by controlling the magnitude or cycle of the applied voltage manually or automatically, for example, by using an automatic control circuit. Also, the amount and ion concentration of the strong oxidizing materials can be adjusted by varying the sizes of electrodes, the distance between electrodes, the width or amount of water flow. Further, weak alkali water and weak acid water as well as neutral water of pH 7 can be made by using a means for mixing and neutralizing the positive electrode water (strong acid water) and the negative electrode water (strong alkali water) output through the drain ducts of the respective electrodes. Such neutral water contains a considerable amount of oxidizing materials generated by discharge and electrolysis, therefore, has a sufficient sterilizing and disinfecting effect. Thus, the neutral water can also be advantageously used for the purpose of sterilization, disinfection, deodorization and washing.

In case the electrolyzed water generator is installed in the post mix beverage dispenser according to the present invention, acid water, alkali water or neutral water can be selectively prepared based on the option by a controller. Thus, appropriate electrolyzed water can be generated for use according to the purpose of sterilization, disinfection, deodorization or washing of the inside of the dispenser. For example, after circulating acid water inside the dispenser, drinkable weak alkali water is generated and circulated, thereby neutralizing the previous trace of acid water. Also, after circulating acid water or alkali water, neutral water is preferably circulated.

In the above-described ozonated water generator or electrolyzed water generator, the facing electrodes are preferably made of platinum (Pt), a platinum/palladium (Pt/Pd) alloy, a Pt group/Pd alloy, or a conductive metal such as titanium (Ti) coated with Pt, a Pt/Pd alloy or a Pt group/Pd alloy. In case of using the Pt/Pd alloy, 85.0 to 99.95 wt % of Pt and 15.0 to 0.05 wt % of Pd are preferably contained in the alloy. Carbon electrodes having electric conductivity and other electrode properties manufactured by subjecting carbon powder extracted from charcoal or carbon fiber obtained by carbonizing polyacryl fibers to a compressive molding process at high-temperature and high-pressure condition and a high-temperature carbonization process, can also be used for the facing electrodes of the functional water generator according to the present invention. When the carbon electrodes are employed to the functional water generator according to the present invention, they exhibit similar properties and performance to metallic conductors and are cost-efficient.

Also, the distance between the facing electrodes of the functional water generator is preferably 0.1 to 10 mm, and the structure thereof may be a panel type, a flat panel type having one or more holes, a small strip type, a fine wire type, a fish bone type, a mesh type or a cylinder type. Although square electrodes have been illustrated and described in the embodiment, the facing electrodes may have any shapes, including a circular or rectangular shape.

In the ozonated water generator or electrolyzed water generator according to the present invention, a direct-current (DC) voltage, a pulse voltage, a square wave pulse voltage, a sequence-controlled pulse voltage or an alternating pulse voltage can be applied to the facing electrodes.

Figure 9:
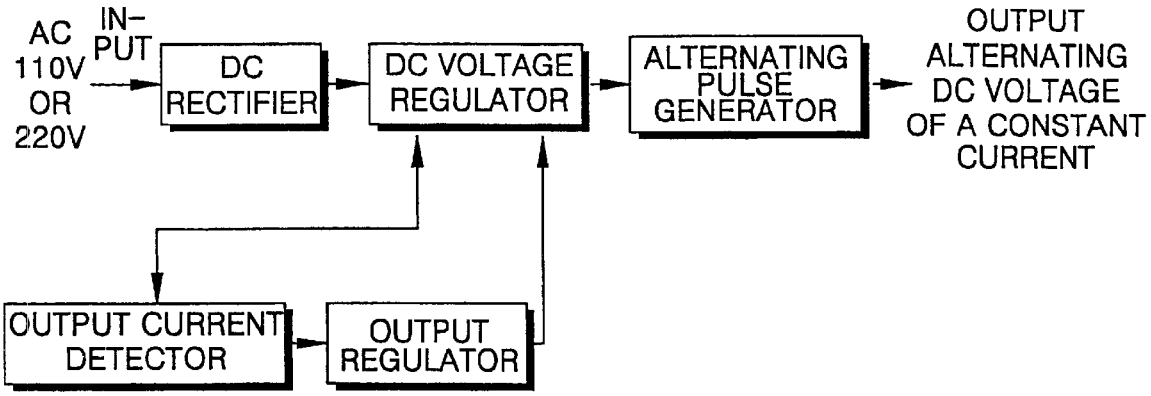
FIG. 9 is a block diagram of a power generation mechanism applied to the functional water generator that can be used in the post mix beverage dispenser according to the present invention.

FIG. 9 is a block diagram of a power generation mechanism applied to the functional water generator that can be used in the post mix beverage dispenser according to the present invention. Here, an AC voltage of 110 or 220 V is applied to a DC rectifier for DC rectification to generate a predetermined DC voltage. Next, the DC voltage regulator detects output current and regulates output current into a constant magnitude to prevent the DC voltage from varying due to the change of the AC voltage of 110 or 220 V. The adjusted DC voltage is output as an alternating DC voltage of a constant current via an alternating pulse generator.

The functional water generator applied to the post mix beverage dispenser according to the present invention may include a UV lamp as well as an ozonated water generator and an electrolyzed water generator. Therefore, the post mix beverage dispenser equipped with a UV lamp to generate ozonated water may be within the scope of the present invention.

The following examples are provided for showing the sterilizing efficiency of the post mix beverage dispenser having the functional water generator according to the present invention.

EXAMPLE 1

Sterilizing Efficiency

An ozonated water generator shown in FIG. 7 was mounted on a water supply duct of the post mix beverage dispenser shown in FIG. 2, and the sterilizing efficiency was tested while adjusting currents. The water tank of the beverage dispenser was filled with tap water containing bacteria (*E.coli* and O-157) in a concentration of 1,400 cells/ml, and then the ozonated water generator was operated. Then, the number of bacteria contained in the discharged water was examined according to the lapse of time.

Table 1 shows the number of bacteria according to the operation of the ozonated water generator installed in the post mix beverage dispenser according to the present invention.

TABLE 1

| Current (A) | | 1 | 2 |
|---|---|---|---|
| Number of bacteria (CFU/0.1 ml) | Raw water | 140 | 140 |
| | After 10 sec | 0 | 0 |
| | After 30 sec | 0 | 0 |
| | After 60 sec | 0 | 0 |

As confirmed from Table 1, the bacteria contained in drinking water were completely sterilized within 10 seconds by the ozonated water generator mounted in the post mix beverage dispenser according to the present invention.

EXAMPLE 2

Sterilizing Efficiency

An ozonated water generator shown in FIG. 7 was mounted on a water supply duct of the post mix beverage dispenser shown in FIG. 2, and the sterilizing efficiency was tested. The water tank of the beverage dispenser was filled with tap water containing *E. coli* and O-157 in concentrations of $2.5\times10^3$ cells/ml and $1.5\times10^3$ cells/ml, respectively, and then the ozonated water generator was operated. Then, the number of bacteria contained in the discharged water was examined according to the lapse of time. The voltage applied to the ozonated water generator was 1 A.

Table 2 shows the number of bacteria according to the operation of the ozonated water generator installed in the post mix beverage dispenser according to the present invention.

TABLE 2

| Current (A) | | 1 | 1 |
|---|---|---|---|
| Number of bacteria (CFU/0.1 ml) | Raw water | 250 | 150 |
| | After 10 sec | 18 | 0 |
| | After 30 sec | 0 | 0 |
| | After 60 sec | 0 | 0 |

As confirmed from Table 2, even when tap water was severely contaminated by bacteria, the post mix beverage dispenser according to the present invention could sterilize over 90% of bacteria within 10 seconds.

As described above, in the post mix beverage dispenser with a functional water generator according to the present invention, a functional water generator is installed in a water supplier, that is, in a water tank or water supply duct of the beverage dispenser to generate functional water such as ozonated water or electrolyzed water having various functions such as sterilization, disinfection, deodorization or washing, thereby simultaneously performing sterilization, disinfection, deodorization and washing of water as well as containers and conduits installed inside the beverage dispenser, such as a water supply duct, a water tank, a mixing tub, an ingredient supply tube, a dispensing valve, or the like. While the conventional automatic vending machine in which ozone gas is generated in air by the ozone generator and dissolved into water stored in the water tank has the problems of safety and financial burden of equipment, in the post mix beverage dispenser according to the present invention, sterilization, disinfection, deodorization or washing of both drinking water and containers and conduits in the machine can be simultaneously performed, without causing such problems as safety and cost.

What is claimed is:

1. A post mix beverage dispenser equipped with a sterilizer comprising:

a water supplier for supplying drinking water;

an ingredient container for storing a beverage ingredient;

an ingredient supply tube connected to the ingredient container for supplying the beverage ingredient;

a carbon dioxide tank for storing and supplying carbon dioxide gas;

a mixing tub for mixing the drinking water supplied from the water supplier and the carbon dioxide supplied from the carbon dioxide tank to produce carbonated water;

a discharge pump for discharging the beverage ingredient;

a dispensing valve opened by the action of a dispensing lever for discharging the carbonated water in the mixing tub and the beverage ingredient;

a dispensing nozzle for discharging the carbonated water and the beverage ingredient into a cup; and a functional water generator for generating functional water in the water supplier by facing electrodes provided to operate in water, wherein the functional water generator is one of an ozonated water generator having at least one pair of facing electrodes and an electrolyzed water generator having at least one pair of facing electrodes disposed with a separating layer interposed therebetween.

2. The dispenser according to claim 1, wherein the functional water generator is installed in the water supplier and operated by means of supplying a power source to sterilize a water supply passage.

3. The dispenser according to claim 1, wherein the facing electrodes are made of platinum (Pt), a platinum/palladium (Pt/Pd) alloy or a Pt group/Pd alloy.

4. The dispenser according to claim 1, wherein the facing electrodes are made of a conductive metal coated with platinum (Pt), a platinum/palladium (Pt/Pd) alloy or a Pt group/Pd alloy.

5. The dispenser according to claim 4, wherein the conductive metal is titanium (Ti).

6. The dispenser according to claim 1, wherein the facing electrodes are carbon electrodes having electric conductivity.

7. The dispenser according to claim 1, wherein the facing electrodes are of a plane type, a flat panel type having one or more holes, a small strip type, a fine wire type, a fish bone type, a mesh type or a cylinder type, and the distance of the facing electrodes is in the range of 0.1 to 10 mm.

8. The dispenser according to claim 1, further comprising a power source for applying a direct-current (DC) voltage, a pulse voltage, a square wave pulse voltage, a sequence-controlled pulse voltage or an alternating pulse voltage to the functional water generator.

9. A post mix beverage dispenser equipped with a sterilizer comprising:

means for storing and supplying drinking water;

means for storing and supplying a beverage ingredient;

means for storing and supplying carbon dioxide;

means for mixing the supplied drinking water and the carbon dioxide to produce a carbonated water;

means for discharging the beverage ingredient and carbonated water to the outside; and means for generating one of ozonated water and electrolyzed water in the drinking water by means of facing electrodes provided to operate in water.

10. A sterilizing and washing method of a post mix beverage dispenser having a water supplier for supplying the drinking water, an ingredient container for storing a beverage ingredient, an ingredient supply tube connected to the ingredient container for supplying the beverage ingredient, a carbon dioxide tank for storing and supplying carbon dioxide gas, a mixing tub for mixing the drinking water supplied from the water supplier and the carbon dioxide supplied from the carbon dioxide tank to produce carbonated water, a discharge pump for discharging the beverage ingredient, a dispensing valve opened by the action of a dispensing lever for discharging the carbonated water in the mixing tub and the beverage ingredient, and a dispensing nozzle for discharging the carbonated water and the beverage ingredient into a cup, wherein the method comprises the steps of:

generating one of ozonated water and electrolyzed water in the water supplier by facing electrodes provided to operate in water; and discharging the one of ozonated water and electrolyzed water and the dispensing nozzle through the mixing tub, or through the ingredient supply tube.

11. A post mix beverage dispenser equipped with a sterilizer comprising:

a water supplier for supplying drinking water;

an ingredient container for storing a beverage ingredient;

an ingredient supply tube connected to the ingredient container for supplying the beverage ingredient;

a carbon dioxide tank for storing and supplying carbon dioxide gas;

a mixing tub for mixing the drinking water supplied from the water supplier and the carbon dioxide supplied from the carbon dioxide tank to produce carbonated water;

a discharge pump for discharging the beverage ingredient;

a dispensing valve opened by the action of a dispensing lever for discharging the carbonated water in the mixing tub and the beverage ingredient;

a dispensing nozzle for discharging the carbonated water and the beverage ingredient into a cup; and a functional water generator for generating functional water in the water supplier by facing electrodes provided to operate in water, wherein the functional water generator is connected to the ingredient supply tube and operated by means of supplying a power source to sterilize a beverage ingredient supply passage.

12. A post mix beverage dispenser equipped with a sterilizer comprising:

a water supplier for supplying drinking water;

an ingredient container for storing a beverage ingredient;

an ingredient supply tube connected to the ingredient container for supplying the beverage ingredient;

a carbon dioxide tank for storing and supplying carbon dioxide gas;

a mixing tub for mixing the drinking water supplied from the water supplier and the carbon dioxide supplied from the carbon dioxide tank to produce carbonated water;

a discharge pump for discharging the beverage ingredient;

a dispensing valve opened by the action of a dispensing lever for discharging the carbonated water in the mixing tub and the beverage ingredient;

a dispensing nozzle for discharging the carbonated water and the beverage ingredient into a cup;

a functional water generator for generating functional water in the water supplier by facing electrodes provided to operate in water; and a nozzle washing device installed out of the dispensing nozzle, which is operated by supplying a power source to the functional water generator and by draining the water in the water tank to sterilize both the inside and outside of the dispensing nozzle.

* * * * *